US008166880B2

(12) United States Patent
Lafont

(10) Patent No.: US 8,166,880 B2
(45) Date of Patent: May 1, 2012

(54) MICRO-MACHINED OR MICRO-ENGRAVED SAFETY AND ARMING DEVICE

(75) Inventor: Renaud Lafont, Bourges (FR)

(73) Assignee: Nexter Munitions, Versailles (FR)

( * ) Notice: Subject to any disclaimer, the term of this patent is extended or adjusted under 35 U.S.C. 154(b) by 549 days.

(21) Appl. No.: 12/318,646

(22) Filed: Jan. 5, 2009

(65) Prior Publication Data

US 2009/0205526 A1 Aug. 20, 2009

(51) Int. Cl.
*F42C 15/196* (2006.01)

(52) U.S. Cl. ..... 102/231

(58) Field of Classification Search ..... 102/231, 102/233, 235, 237, 242–244, 247, 249, 251, 102/253, 254, 256, 229, 222, 226, 221
See application file for complete search history.

(56) References Cited

U.S. PATENT DOCUMENTS

| | | | | |
|---|---|---|---|---|
| 2,006,575 | A * | 7/1935 | Methlin | 102/231 |
| 2,887,057 | A * | 5/1959 | Severance | 102/231 |
| 2,989,923 | A * | 6/1961 | Rodriguez Villa et al. | 102/230 |
| 3,045,598 | A * | 7/1962 | Brown et al. | 102/231 |
| 3,313,236 | A * | 4/1967 | Lohmann | 102/256 |
| 3,603,259 | A * | 9/1971 | Webb | 102/235 |
| 3,958,511 | A * | 5/1976 | Morrow et al. | 102/251 |
| 4,195,575 | A * | 4/1980 | Deuker et al. | 102/232 |
| 4,738,201 | A * | 4/1988 | Holt | 102/231 |
| 4,938,138 | A * | 7/1990 | Maruska | 102/235 |
| 6,167,809 | B1 | 1/2001 | Robinson et al. | |
| 6,964,231 | B1 * | 11/2005 | Robinson et al. | 102/235 |
| 7,051,656 | B1 | 5/2006 | Koehler et al. | |
| 7,194,889 | B1 | 3/2007 | Jean et al. | |
| 7,490,553 | B2 * | 2/2009 | Magnan et al. | 102/254 |
| 7,823,335 | B2 * | 11/2010 | Lin | 52/58 |
| 2007/0101888 | A1 | 5/2007 | Magnan et al. | |

FOREIGN PATENT DOCUMENTS

EP 1 780 496 A1 5/2007

* cited by examiner

*Primary Examiner* — Bret Hayes
*Assistant Examiner* — Reginald Tillman, Jr.
(74) *Attorney, Agent, or Firm* — Oliff & Berridge, PLC

(57) ABSTRACT

A micro-machined or micro-engraved safety and arming device for a pyrotechnic train of a projectile to which axial spin is imparted after firing, such device comprising a substrate onto which a shutter to break the pyrotechnic train is positioned, such shutter being mobile in translation on the substrate, device in which the train-breaking shutter is held immobile by at least two locks, a first lock, or axial acceleration lock, which is released further to the application of the acceleration communicated to the projectile during firing, and a second lock, device wherein the second lock is a centrifugal lock that is released further to the projectile being made to spin.

9 Claims, 3 Drawing Sheets

MICRO-MACHINED OR MICRO-ENGRAVED SAFETY AND ARMING DEVICE

BACKGROUND OF THE INVENTION

1. Field of the Invention

The technical scope of the invention is that of safety and arming devices for the pyrotechnic train of a projectile, and namely micro-machined safety and arming devices.

2. Description of the Related Art

Safety and arming devices (DSA) are well known. They generally incorporate a screen obturating a transmission channel linking a detonator and pyrotechnic charge.

The screen therefore is interposed on the transmission of the detonic wave between the detonator and the charge and prevents the latter from functioning.

One of the problems encountered with conventional devices lies in their volume. The parts are relatively large to be able to ensure the interruption of the pyrotechnic chain. Drive means enabling the screen to be moved are necessarily powerful. Springs are used, more often than not, which remain tensed during the storage phases, and which can lead to a deterioration of their mechanical properties and to a reduction in the weapon's reliability.

In the past few years, the manufacture of all or part of safety devices has been proposed using chips that incorporate electromagnetic elements micro-machined or micro-engraved either in an element deposited on a substrate or directly on the substrate itself. This technology, known by the term MEMS (Micro Electro Mechanical System) in fact currently enables micro mechanisms to be manufactured that implement technology close to that enabling the manufacture of electronic integrated circuits.

U.S. Pat. No. 6,964,231 describes such a micro-machined safety device incorporating a shutter that carries a pyrotechnic charge and slides by the action of the centrifugal force. This shutter is itself held immobile by a lock, which is made to retract by the acceleration of the projectile being fired.

Another tipping lock enables the shutter to be released and moved to the position in which it is armed by the force of centrifugal inertia. The tipping lock is activated by a gas-generating pyrotechnic composition whose ignition is controlled by electronic means.

Such a safety and arming device requires two independent environmental conditions to be used to ensure arming: longitudinal firing acceleration and centrifugal acceleration. This double safety enables the device to conform to the strictest standards in terms of projectile arming and safety (STANAG 4187).

It is however complicated in structure and namely the second lock (tipping lock) requires the implementation of a pyrotechnic composition as well as means to ignite such composition. Electronics must be provided to pilot the functioning of this MEMS that are not well adapted to use in medium caliber ammunition (caliber of less than 40 mm) in which there is little available space.

SUMMARY OF THE INVENTION

The aim of the invention is to propose a micro-machined safety and arming device that is simple in structure and is able to satisfy the strictest safety conditions, namely by requiring the presence of two independent environmental conditions for it to be able to move into the armed position.

The device according to the invention implements 100% mechanical arming whilst ensuring the reliable interruption of the pyrotechnic train.

Thus, the invention relates to a micro-machined or micro-engraved safety and arming device for a pyrotechnic train of a projectile to which axial spin is imparted after firing, such device comprising a substrate onto which a shutter to break the pyrotechnic train is positioned, such shutter being mobile in translation on the substrate, device in which the train-breaking shutter is held immobile by at least two locks, a first lock (or axial acceleration lock) which is released further to the application of the acceleration communicated to the projectile during firing, and a second lock, device wherein the second lock is a centrifugal lock that is released further to the projectile being made to spin.

According to a preferred embodiment, the centrifugal lock comprises at least one locking finger integral with the substrate, such finger being held in an indentation in the shutter when it is in its locking position, it being held in place by a micro-machined centrifugal counterweight which is itself mounted able to slide in a housing in the shutter.

The centrifugal counterweight will be mounted able to slide against the action of first spring means.

Braking means may be provided to slow down the movement of the counterweight.

The shutter itself may advantageously slide through the action of the centrifugal force and against the action of a second spring means.

The locking finger may be made integral with the substrate by means of a flexible tab.

According to a particular embodiment, the braking means may comprise lugs integral with at least one of the flexible tabs, such lugs coming to rub against a lateral surface of the counterweight.

The substrate will advantageously incorporate an orifice on either side of the shutter, the axis of these orifices, and thus the direction of action of the pyrotechnic train, being substantially parallel to the plane of the shutter.

BRIEF DESCRIPTION OF THE DRAWING

The invention will become more apparent from the following description of a particular embodiment, such description made with reference to the appended drawings, in which.

DETAILED DESCRIPTION OF PREFERRED EMBODIMENTS

Figure 1:
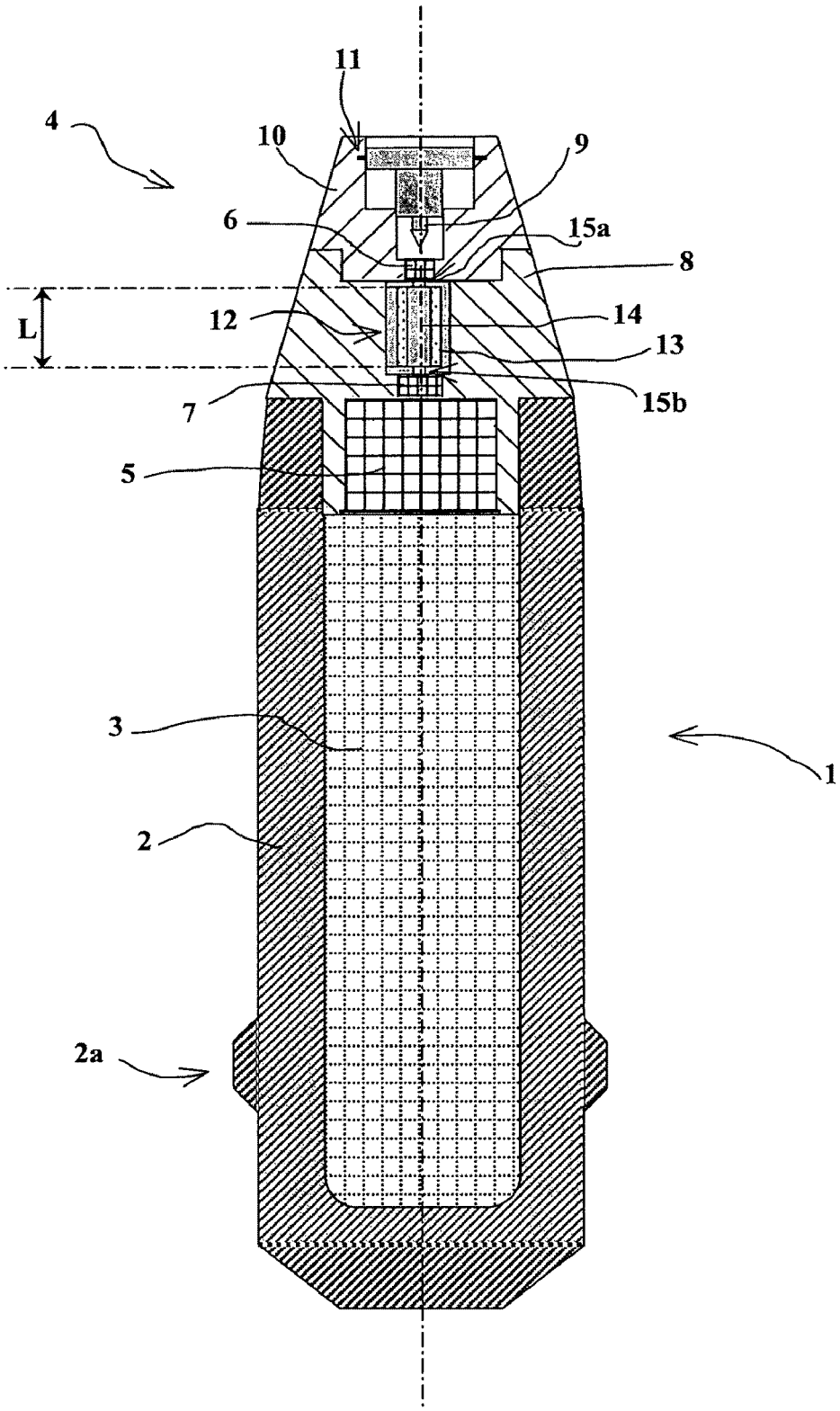
FIG. 1 is a schematic section view of a medium caliber projectile equipped with a fuse incorporating a safety and arming device according to the invention.

FIG. 1 shows a projectile 1 of medium caliber (caliber of less than 50 mm), which comprises a body 2 enclosing an explosive load 3. The body 2 receives a fuse 4 at its front part that is screwed into a tapping into the body 2. The fuse 4 comprises a case 8 which encloses a priming charge 5. The priming charge 5 is intended to be ignited by a pyrotechnic train comprising a detonator 6 and relay 7 (alternatively, this relay 7 could be omitted and the detonator 6 would in this case ignite the priming charge 5 directly). The detonator 6 is a percussion detonator which is ignited by a firing pin 9 able to slide in a nose 10 integral with the case 8 of the fuse 4. When the projectile 1 impacts a target, the firing pin 9 is projected by the detonator 6. The firing pin is held in place during the storage and firing phases by a shearable washer 11.

It is naturally possible for the device according to the invention to be implemented using an electric detonator 6 that is controlled, for example, by electronic timer means or by a proximity detector.

The fuse 4 also encloses a safety and arming device 12 enabling the pyrotechnic train to be broken during the storage phase and at the beginning of the firing phase of the projectile 1.

In accordance with the invention, this safety and arming device is made in the form of a micro-machined or micro-engraved device (MEMS). It thus comprises a substrate 13 onto which a sliding shutter 14 is mounted which will ensure the breaking of the pyrotechnic train.

The substrate 13 incorporates two orifices 15*a* and 15*b* positioned on either side of the shutter 14. The axis of these orifices 15*a*, 15*b*, and thus the direction of action of the pyrotechnic train (6-7), is thus substantially parallel to the plane of the shutter 14.

Such an arrangement of the pyrotechnic train breaking shutter such that the direction of the pyrotechnic train lies facing the thickness of the shutter 14 and not perpendicular to the plane of the shutter (as in traditional MEMS) is known namely by patent EP1780496.

Someone skilled in the art will refer to this patent which describes the general characteristics of such a type of priming train and of the shutter associated with it.

We note also that the detonator 6 must be of a smallest size enabling its function to be ensured and will be coupled with a suitable pyrotechnic relay 7 (or 5). We were able to verify that by implementing a detonator incorporating an output stage with 100 milligrams of hexogen coupled with a very insensitive relay, for example of HNS (hexanitrostilbene), it was possible for orifices 15*a*, 15*b* (or transmission channels) to be made with a section of less than 1 $mm^2$ (diameter of the channel of around 1 mm) whilst guaranteeing the required transmission of the ignition.

It is thus possible to break the pyrotechnic effect using a silicon shutter with a length L of approximately 3 mm, which is perfectly possible with MEMS technologies. This length, approximately 3 mm, of silicon thus corresponds to the length L of the shutter 14 referenced in FIGS. 1 and 2.

The projectile 1 is furthermore provided with a band 2*a* which engages the rifling of the barrel (not shown) and which imparts to the projectile 1 a spin motion around its own axis during firing.

Figure 2:
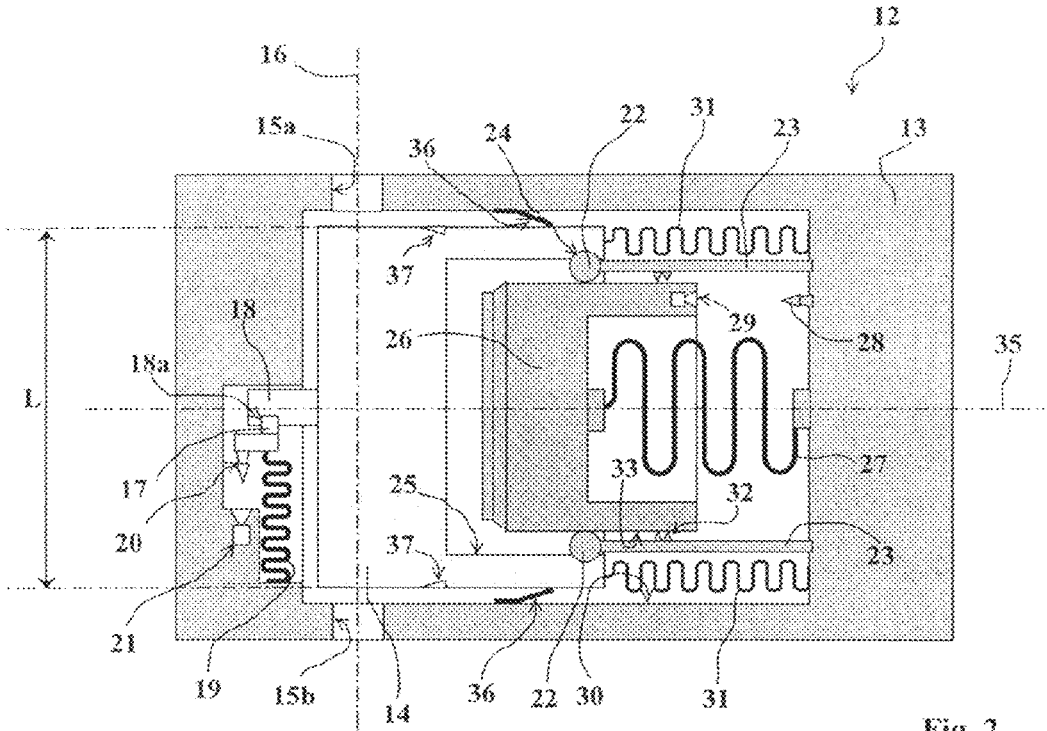
FIG. 2 is a view of one embodiment of the safety and arming device according to the invention, in its safety position.

FIG. 2 gives a more detailed view of the internal structure of the safety device 12 according to the invention.

The device thus comprises a substrate 13 on which a shutter 14 to break the pyrotechnic train is arranged that is able to translate on the substrate.

The shutter 14 is made by micro-machining or micro-engraving using MEMS techniques, which are well known to the Expert.

The Figures shows orifices 15*a* and 15*b* which are arranged on either side of the shutter 14 as well as the axis 16 of these orifices (and thus the direction of action of the pyrotechnic train). The dimension L of the shutter 14 ensures the interruption of the pyrotechnic train in the safety position of the device 12.

The shutter 14 to break the train is held immobile by two locks.

A first lock 17 (or axial acceleration lock) and a second lock, which is a centrifugal lock released further to the spinning of the projectile 1.

Thus, contrary to known device U.S. Pat. No. 6,964,231 which requires a tipping lock activated by a specific pyrotechnic composition, the device according to the invention directly uses the centrifugal inertia to unlock the shutter 14 whilst continuing to keep the safety in place during the first part of the trajectory (no arming before a certain distance has been covered out of the barrel).

The first lock 17 cooperates with a notch 18*a* carried by a rod 18 integral with the shutter 14.

This lock 17 is held in position in the rod 18 by spring means 19 positioned between the lock 17 and the substrate 13.

The lock 17 also carries a strip 20 which has at least one indentation. This strip 20 is intended to cooperate with a matching cavity 21 made in the substrate to ensure that the first lock 17 is immobilized in its unlocked position.

The spring means 19 are naturally also made using micro-machining or micro-engraving technologies (MEMS technologies). The mechanical characteristics of the spring means 19 are selected such that the lock 17 is only disengaged further to the stresses linked to the firing acceleration of the projectile 1. This lock must, however, remain in its locking position when subjected to the stresses linked to handling or falls of the projectile.

The centrifugal lock comprises at least one locking finger 22 which is integral with the substrate 13.

The device here comprises two fingers 22 made in the form of micro-machined or micro-engraved cylindrical discs that are made integral with the substrate 13 by means of flexible tabs, also micro-machined or micro-engraved.

Each finger 22 is housed in an indentation 24 of a matching shape arranged in a housing 25 in the shutter 14.

In the locking position shown in FIG. 2, the fingers 22 are held in the indentations 24 by a micro-machined or micro-engraved centrifugal counter-weight 26 that is itself mounted able to slide with respect to the substrate 13 and in a housing 25 in the shutter 14.

The counter-weight 26 is held in its locking position (FIG. 2) by first spring means 27 (also micro-machined or micro-engraved). Naturally, the mechanical properties of the first spring means 27 are selected such that the counter-weight 26 only moves further to the stresses linked to the centrifugal acceleration resulting from the spinning of the projectile 1 during firing. The counter-weight must, however, remain in its locking position when subjected to stresses linked to handling or falls of the projectile.

The substrate 13 carries a strip 28 which has at least one indentation. This strip 28 is intended to cooperate with a matching cavity 29 in the counter-weight 26 to ensure that the counter-weight 26 is held immobile in its unlocked position.

The shutter 14 is itself mounted able to slide in a housing 30 in the substrate 13. Once the locks 17, 22 have been removed, the shutter 14 is able to slide into this housing 30 through the action of the centrifugal force and against the action of second spring means 31 (formed here of two parallel springs).

Lastly, braking means are provided to slow down the displacement of the counter-weight 26.

These means comprise lugs 32 integral with the flexible tabs 23 and which rub against the lateral surfaces 33 of the counter-weight 26 (such surfaces which may be provided with asperities or surface roughness). The braking means enable the displacement of the counter-weight 26, and thus the retraction of the centrifugal locks 22, to be slowed down. Muzzle safety is thus ensured during firing. The device 12 is only armed after a certain distance has been traveled after exiting the gun barrel.

The functioning of the device will now be described with reference to FIGS. 3*a* to 3*c*.

Figure 3A:
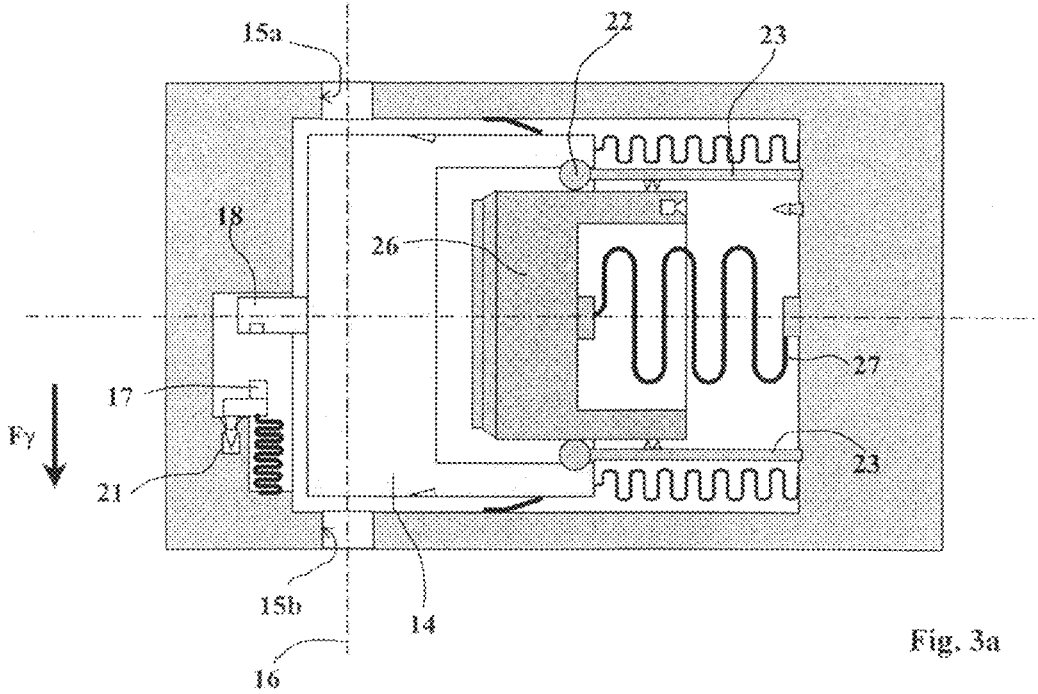
FIGS. 3*a*, 3*b* and 3*c* show this same device during the different steps which lead to its arming.

FIG. 3*a* shows the device in the position it adopts inside the gun barrel during firing.

The firing acceleration causes the appearance of an axial inertia force Fγ on the first lock 17. This lock thus releases the shutter 14. The lock 17 remains immobilized in its unlocked position by the fact that the strip 20 is engaged in the cavity 21.

The shutter 14 is however still held in its safety position by the centrifugal lock 26/22.

Indeed, the spin rate in not yet enough to cause the counter-weight 26 to move away. The shutter 14 is still breaking the pyrotechnic train.

Figure 3B:
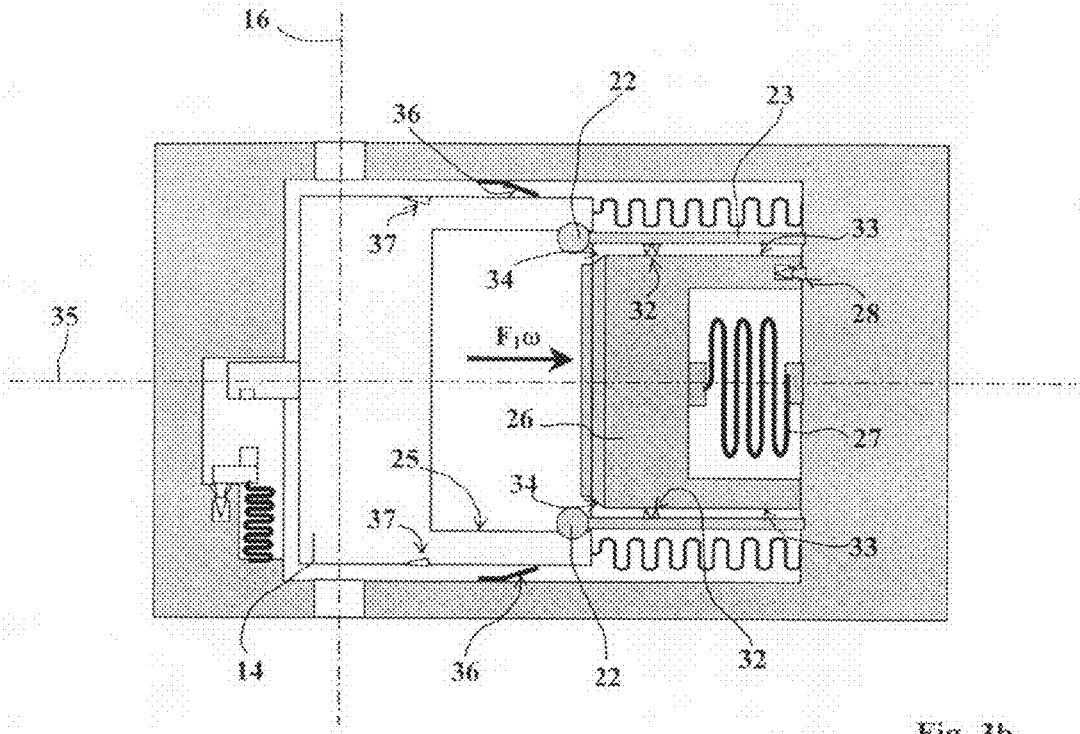

FIG. 3*b* shows the device in the position it adopts upon exiting the gun barrel at a distance of approximately 50 meters.

The centrifugal acceleration has caused the appearance of a radial inertia force $F_1\omega$ that is exerted on the counter-weight 26. The counter-weight is progressively distanced against the action of the second spring means 27 and its displacement is slowed down by the friction of the lugs 32 on the lateral surfaces of the counter-weight 26.

The stiffness of the spring means 27, and the braking means 32, 33 are defined so as to delay the passage of the counter-weight 26 into its unlocked position, such that the configuration according to FIG. 3*b* is only reached at a distance of approximately 50 meters from the gun barrel. Safety is thus optimized for the gun crew.

Once the counter-weight 26 is locked in this position by the strip 28 being engaged in the matching cavity 29, the centrifugal locks 22 are no longer held by the counter-weight 26 (which additionally has beveled front profiles 34 so as to facilitate the release of the locks 22).

Figure 3C:
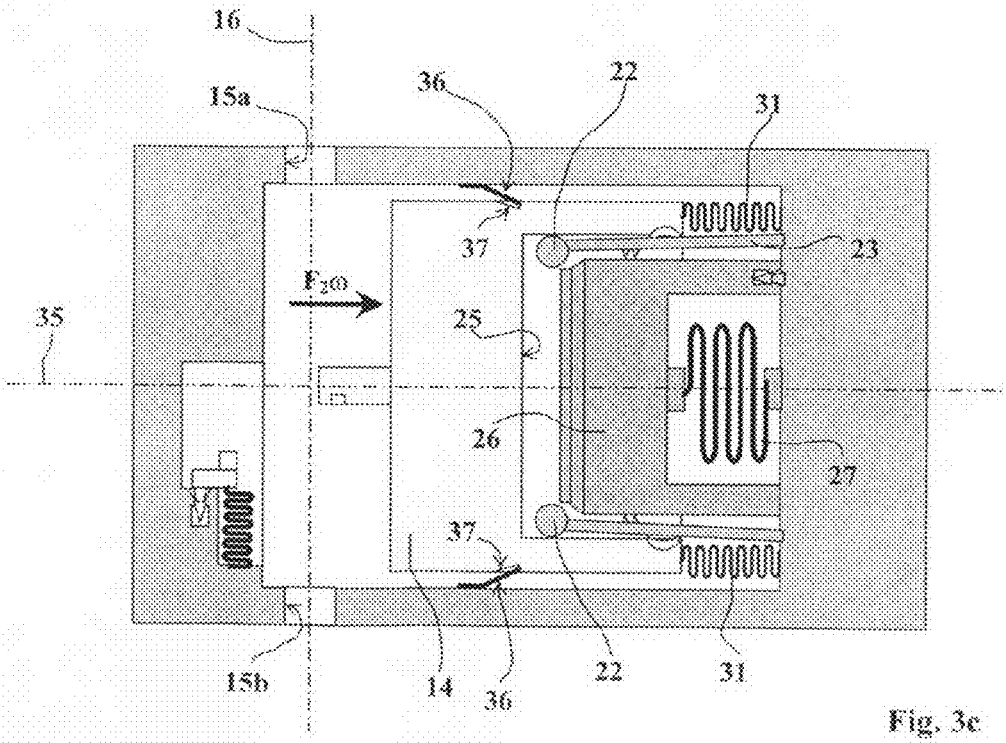

The shutter 14 is thus no longer immobilized by the locks 22 and is thus able to adopt its unlocked position (FIG. 3*c*).

It is also displaced by the effect of a centrifugal inertia force $F_2\omega$ and against the action of the second spring means 31.

The displacement of the shutter causes the tabs 23 carrying the locks 22 to bend. The housing 25 is designed to be of a depth that is enough to enable the locks 22 to pass between the counter-weight 26 and the shutter 14.

The shutter 14 no longer blocks the orifices 15*a*, 15*b*. The direction of action 16 of the pyrotechnic train is thus no longer obstructed and the device is in its armed position. An impact on a target will cause the explosive load of the projectile to ignite.

We observe that the shutter 14 is locked in its armed position by tabs 36 integral with the substrate 13 and which are engaged in notches 37 arranged on a lateral surface of the shutter 14 so as to prevent that latter from returning to its safety position.

We see that the device according to the invention is extremely simple and does not take up a lot of space. Its structure is fully mechanical and it may be incorporated into a medium caliber projectile at a small cost.

The axis 35 along which the counter-weight 26 and shutter 14 are displaced is perpendicular to the axis 16 of the pyrotechnic action. When the device is set into place on a projectile, axis 35 corresponds to the radial direction of the projectile and the centrifugal inertia can thus be exerted on the counter-weight 26 and the shutter 14. It is thus extremely simple to integrate the device into a projectile despite the reduced dimensions of this device 12. Indeed, the pyrotechnical alignment of the axis 16 necessarily leads to the proper orientation of the device with respect to the projectile.

Different variants are possible without departing from the scope of the invention.

Namely, it is possible for different technical solutions to be adopted for means 20/21, 28/29 that ensure the immobilization of the locks. The spring means may have different forms. They will be defined according to the firing constraints to which the projectile will be subjected.

It is also possible for the safety and arming device according to the invention to be associated with an electrical ignition detonation 6 coupled, for example, with electronic timer or proximity detection means.

What is claimed is:

1. A micro-machined or micro-engraved safety and arming device for a pyrotechnic train of a projectile to which axial spin is imparted after firing, said device comprising a substrate onto which a shutter to block a direction of an action of said pyrotechnic train is positioned, said shutter being mobile in translation on said substrate, said device in which said shutter being held immobile by at least two locks, a first lock, or axial acceleration lock, which is released further to the application of the acceleration communicated to said projectile during firing, and a second lock, wherein said second lock is a centrifugal lock that is released further to said projectile being made to spin, wherein said centrifugal lock comprises at least one locking finger integral with said substrate, said finger being held in an indentation in said shutter when said finger is in its locking position, said finger being held in place by a micro-machined centrifugal counterweight which is itself mounted able to slide in a housing in said shutter.

2. A safety and arming device according to claim 1, wherein said centrifugal counterweight is mounted able to slide against the action of a first spring means.

3. A safety and arming device according to claim 2, wherein braking means are provided to slow down the movement of said counterweight.

4. A safety and arming device according to claim 1, wherein said shutter itself slides through the action of the centrifugal force and against the action of a spring means.

5. A safety and arming device according to claim 1, wherein said locking finger is made integral with said substrate by means of a flexible tab.

6. A safety and arming device according to claim 3, wherein said braking means comprise lugs integral with at least one of flexible tabs, said lugs coming to rub against a lateral surface of said counterweight.

7. A safety and arming device according to claim 1, wherein said substrate incorporates two orifices facing the sides of said shutter, the axis of said two orifices, and thus the direction of action of said pyrotechnic train, being substantially parallel to a plane surface of said shutter.

8. A safety and arming device according to claim 3, wherein said shutter itself slides through the action of the centrifugal force and against the action of a second spring means.

9. A safety and arming device according to claim 5, wherein breaking means are provided to slow down the movement of said counterweight, and said braking means comprise lugs integral with at least one of said flexible tabs, said lugs coming to rub against a lateral surface of said counterweight.

* * * * *